US005397118A

United States Patent [19]

Iida et al.

[11] Patent Number: 5,397,118

[45] Date of Patent: Mar. 14, 1995

[54] VERTICAL MOVEMENT CONTROL DEVICE FOR A PAPER FEED TABLE DEVICE

[75] Inventors: Kouichiro Iida; Fernando Perez, both of Tokyo, Japan

[73] Assignee: Riso Kagaku Corporation, Tokyo, Japan

[21] Appl. No.: 203,419

[22] Filed: Mar. 1, 1994

[30] Foreign Application Priority Data

Mar. 5, 1993 [JP] Japan ..... 5-045419

[51] Int. Cl.[6] ..... B65H 1/16

[52] U.S. Cl. ..... 271/155; 271/152

[58] Field of Search ..... 271/152, 153, 154, 155, 271/156

[56] References Cited

U.S. PATENT DOCUMENTS

| | | | |
|---|---|---|---|
| 3,123,355 | 3/1964 | Lessig | 271/154 |
| 3,182,941 | 5/1974 | Yanagawa . | |
| 4,457,508 | 7/1984 | Eichler et al. | 271/152 |
| 5,295,678 | 3/1994 | Lindner et al. | 271/152 |

FOREIGN PATENT DOCUMENTS

| | | | |
|---|---|---|---|
| 4010985 | 10/1991 | Germany . | |
| 4020429 | 11/1991 | Germany . | |
| 4100838 | 7/1992 | Germany . | |
| 221029 | 9/1990 | Japan | 271/152 |
| 159932 | 6/1992 | Japan | 271/156 |

*Primary Examiner*—Robert P. Olszewski
*Assistant Examiner*—Boris Milef
*Attorney, Agent, or Firm*—Dickstein, Shapiro & Morin

[57] ABSTRACT

Provided is a vertical movement control device for a paper feed table device which allows a favorable paper feeding action to be carried out at an appropriate paper feed pressure for all kinds of paper without involving any failure to properly lift the paper feed table or any occurrence of seizure of the electric motor, and eliminates any unduly long waiting period even when the required lift of the paper feed table is relatively great due to addition of new paper or removal of paper jamming. An upper limit sensor 19 detects if the upper surface of the paper stack on the paper feed table 1 has reached a prescribed height by the upward movement of the paper feed table 1. The motor 13 is driven in the upward direction in an intermittent manner until the upper limit sensor 19 has detected that the upper surface of the paper stack on the paper feed table 1 has reached the prescribed height, and the duration of the intermittent drive period of the electric motor 13 is gradually increased with the elapsing of time until the upper limit detecting sensor 19 has detected that the upper surface of the paper stack on the paper feed table 1 has been positioned at the prescribed height.

2 Claims, 3 Drawing Sheets

VERTICAL MOVEMENT CONTROL DEVICE FOR A PAPER FEED TABLE DEVICE

TECHNICAL FIELD

The present invention relates to a vertical movement control device for a paper feed table device for use in various image forming devices such as printing devices, duplicating devices and facsimile devices.

BACKGROUND OF THE INVENTION

As a paper feed table for use in various image forming devices such as printing devices, duplicating devices and facsimile devices, there is known the elevator type paper feed table device provided with a paper feed table intended for placing a stack of paper thereon and adapted to be vertically moved by an electric motor.

In an elevator type paper feed table device, it is detected by using upper limit detecting means when the upper surface of the paper stack on the paper feed table has been positioned by the vertical movement of the paper feed table at a prescribed height for taking out the uppermost paper sheet with paper feed rollers or the like, and once it is detected that the upper surface of the paper stack on the paper feed table has reached the prescribed height, the electric motor is stopped from lifting the paper feed table. Every time it is detected by the upper limit detecting means that the upper surface of the paper stack on the paper feed table has gone below the prescribed height by more than a prescribed amount due to the feeding of the paper from the paper feed table, the electric motor is activated so as to lift the paper feed table by the corresponding amount.

In such an elevator type paper feed table device, it is essential for accurate and satisfactory paper feeding action to be carried out at an appropriate paper feed pressure that the paper feed table stops its upward movement as soon as the upper limit detecting means has detected that the upper surface of the paper stack on the paper feed table has reached the prescribed height. If there is any fluctuation in the height of the paper feed table, the paper feed pressure also fluctuates, and a satisfactory sheet by sheet paper feeding action cannot be attained particularly when relatively thin paper is to be fed.

Based on such a consideration, it is conceivable to reduce the rotational speed of the electric motor by controlling the voltage of the electric power supplied to the motor when the thickness of the paper to be fed is relatively small so that the speed of the vertical movement of the paper feed table may be reduced and the unpredictable overrunning of the electric motor due to the inertia of the electric motor as it stops may be controlled.

However, according to this proposal, the setting must be changed depending on the thickness of the paper, and if the setting is not appropriate, the situation may even get worse.

When the voltage of the electric motor is controlled so as to reduce the rotational speed of the electric motor, the resulting reduction in the output torque of the electric motor may cause a failure to properly lift the paper feed table or may even cause a complete seizure or stoppage of the electric motor.

When new paper is added or when paper jam is removed, the amount of the lift of the paper feed table required for positioning the upper surface of the paper stack on the paper feed table to the height that can be detected by the upper limit detecting means increases as compared to the normal lift of the paper feed table when paper is fed sheet by sheet. At such a time also, if the rotational speed of the electric motor is restricted, and the speed of the lifting of the paper feed table is reduced, a substantial time period or a substantial waiting time period is required before the paper feed table is lifted to the height at which the upper surface of the paper stack on the paper feed table is detected by the upper limit detecting means.

BRIEF SUMMARY OF THE INVENTION

The present invention was made in view of such a problem of the conventional paper feed device in lifting the paper feed table, and its primary object is to allow a favorable paper feeding action to be carried out at an appropriate paper feed pressure for all kinds of paper without involving any failure to properly lift the paper feed table or any occurrence of seizure of the electric motor.

A second object of the present invention is to provide a vertical movement control device for a paper feed table device which can adapt itself to different kinds of paper to be fed automatically without requiring any manual change of setting.

A third object of the present invention is to provide a vertical movement control device for a paper feed table device which can eliminate any unduly long waiting period even when the required lift of the paper feed table is relatively great due to addition of new paper or removal of paper jamming.

According to the present invention, these and other objects can be accomplished by providing a vertical movement control device for a paper feed table device including a paper feed table which carries a paper stack thereon and can be vertically moved by an electric motor, comprising: upper limit detecting means for detecting if an upper surface of the paper stack on the paper feed table has been positioned at a prescribed height by a vertical movement of the paper feed table; and control means for intermittently activating the electric motor so as to lift the paper feed table until the upper limit detecting means has detected that the upper surface of the paper stack on the paper feed table has been positioned at the prescribed height.

Thus, by intermittently activating the electric motor, it can be more precisely positioned for optimum paper feed action because the voltage of the electric power supplied to the electric motor is not required to be controlled, and its output torque is not restricted.

Preferably, a duty ratio of the intermittent activation of the electric motor is gradually increased with elapsing of time until the upper limit detecting means has detected that the upper surface of the paper stack on the paper feed table has been positioned at the prescribed height. In particular, if the duty ratio is gradually increased by increasing a period of activating the electric motor while keeping a period of deactivating the electric motor fixed in each duty cycle of the electric motor, the control circuit for the electric motor can be simplified.

Thus, according to the present invention, the electric motor is intermittently activated until the upper limit detecting means has detected that the upper surface of the paper stack on the paper feed table has reached the prescribed height, and the time interval of activating the electric motor in each intermittent cycle is gradually increased until the upper limit detecting means has detected that the upper surface of the paper stack on the paper feed table has reached the prescribed height with the result that the effective lifting speed of the paper feed table is gradually increased in time without the disadvantage of limiting the output torque of the electric motor.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
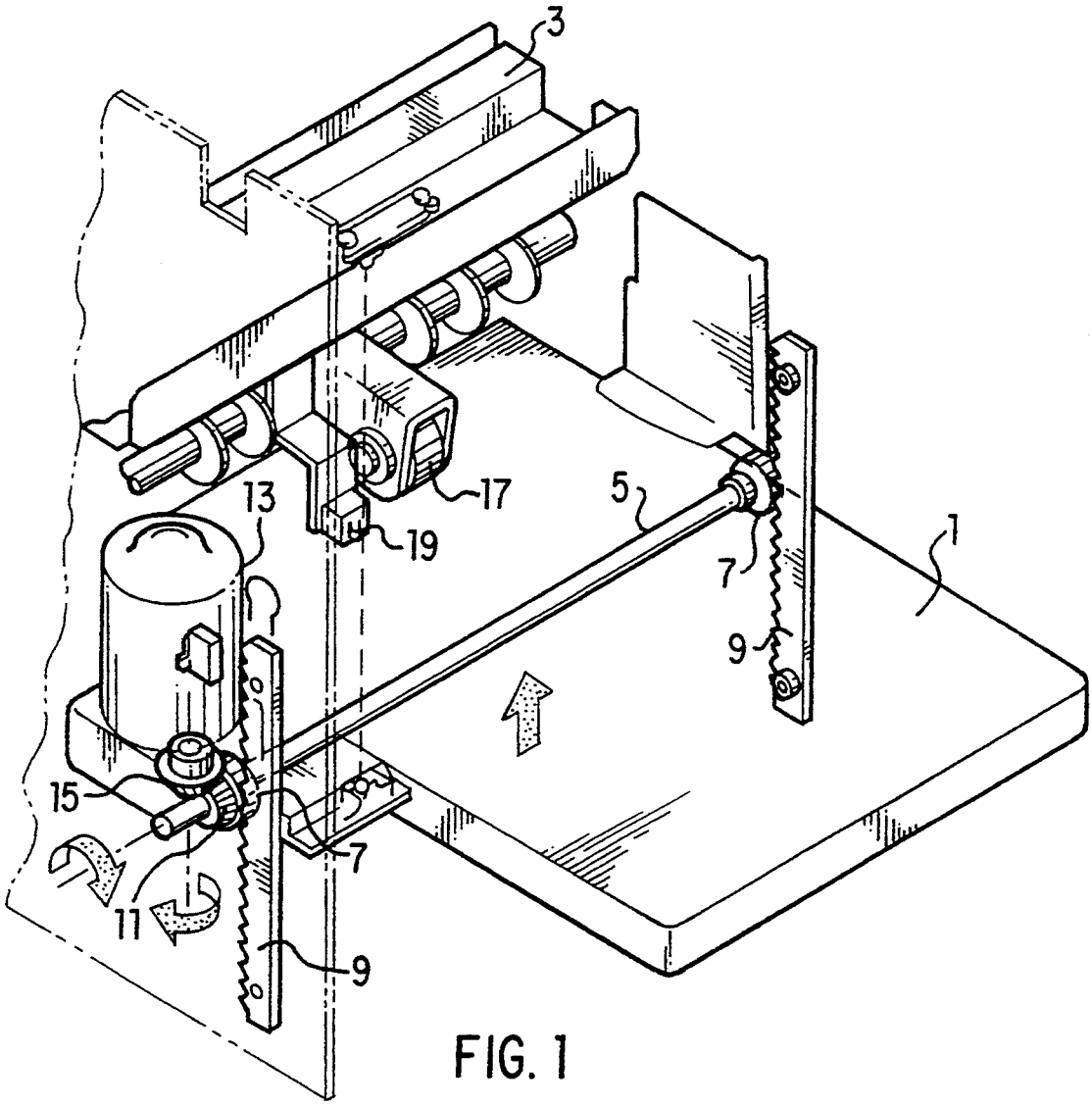
FIG. 1 is a perspective view showing an embodiment of the paper feed device to which the vertical movement control device of the present invention is applied.

FIG. 1 shows an embodiment of the paper feed table device to which the vertical movement control device of the present invention is applied. In FIG. 1, numeral 1 denotes a paper feed table 1 which is vertically moveably mounted on a main body 3, and carries a paper stack thereon.

The paper feed table 1 supports a pinion shaft 5 in a rotatable 1 manner at its lower end, and the pinion shaft 5 is provided with a pinion 7 at each of its two ends. The pinions 7 mesh with associated racks 9 secured to the main body 3 in a vertically immovable manner, and vertically move the paper feed table 1 as they rotate.

The pinion shaft 5 additionally carries a conical gear 11 at one of its ends, and this conical gear 11 meshes with another conical gear 15 mounted on an output shaft of an elevator motor (electric motor) 13 mounted on the paper feed table 1 so that the conical gears are driven in either normal or reverse direction as required.

A paper feed roller 17 is placed in a part of the main body 3 located above the paper feed table 1 to take out paper sheets from the paper stack on the paper feed table 1 sheet by sheet, and an upper limit sensor 19 is fixedly mounted on a part of the main body 3 located directly above the paper feed table 1 to detect the position of the paper feed table 1 at which the upper surface of the paper stack reaches a prescribed height and touches the paper feed roller 17.

Figure 2:
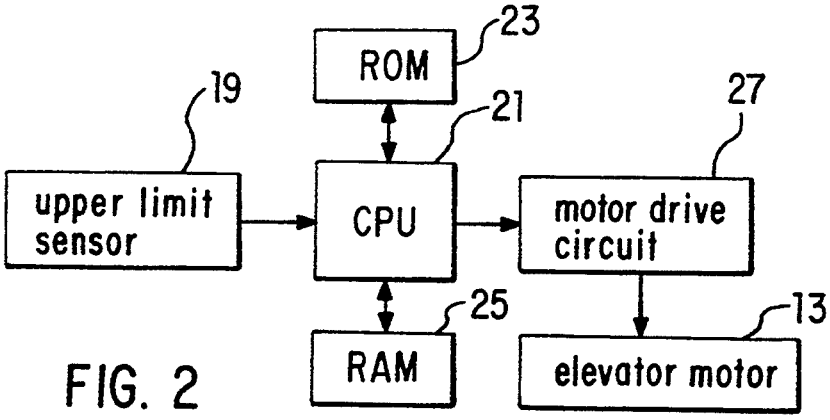
FIG. 2 is a block diagram showing an embodiment of the vertical movement control device for a paper feed table device according to the present invention.

FIG. 2 shows an embodiment of the vertical movement control system for the paper feed table device having the above described structure. This vertical movement control system comprises a CPU 21 consisting of a micro processor or the like, ROM 23 for storing control programs, and RAM 25 for temporarily storing input information, count values and timer values as required, and supplies a command signal to a motor drive circuit 27 of the elevator motor 13 according to the information obtained from the upper limit sensor 19.

The CPU 21 executes control programs, and basically drives the elevator motor 13 in an intermittent manner in the direction to lift the paper feed table until the upper limit sensor 19 has detected that the upper surface of the paper stack on the paper feed table 1 has reached the prescribed level, and supplies an intermittent drive signal to the motor drive circuit 27 so that the intermittent drive time period of each intermittent drive cycle may be extended in time over the range of approximately 10 msec to infinity in dependence on the elapsed time period until the upper limit sensor 19 detects the upper surface of the paper on the paper feed table 1.

Figure 3:
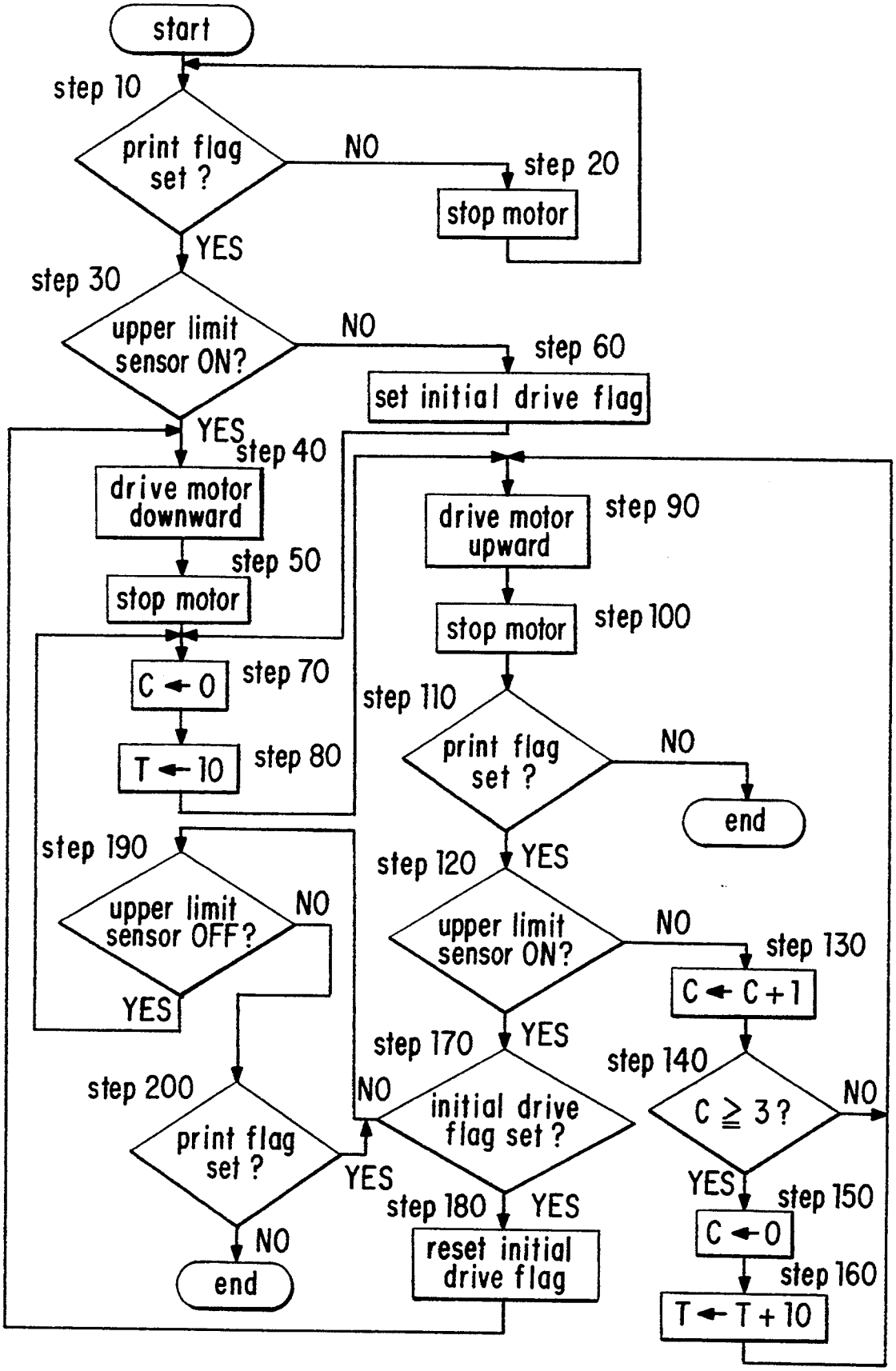
FIG. 3 is a flow chart showing the operation of the vertical movement control device for a paper feed table device according to the present invention.

FIG. 3 shows the control flow involved in the lifting movement of the paper feed table device. In this control flow, first of all, it is determined if a print flag is set or not (step 10). The print flag is set by pressing a print start button. If the print flag is not set, the elevator motor 13 is deactivated, and a stand-by mode is started (step 20).

On the other hand, if the print flag is set, it is then determined if the upper limit sensor 19 is ON or, in other words, if the upper surface of the paper stack on the paper feed table 1 has reached the prescribed height and come into contact with the paper feed roller 17 or not (step 30). At this initial point, if the upper limit sensor 19 is in the ON state, the elevator motor 13 is activated for a prescribed time period, for instance 500 msec, in the downward direction to initialize the position of the paper feed table 1 (step 40), and the elevator motor 13 is deactivated (step 50) before the program flow advances to step 70. As a result, the paper feed table 1 is lowered by a prescribed distance, and the state of the upper limit sensor 19 is changed to OFF.

On the other hand, if the initial state of the upper limit sensor 19 (step 30) is not ON, an initial drive flag is set (step 60) before the program flow advances to step 70.

In step 70, a count value C is reset, and a motor ON timer value T is set to 10 (step 80).

Then, the elevator motor 13 is driven in the upward direction for an intermittent drive time period determined by the motor ON timer value T (step 90). If the motor ON timer value T is 10, the elevator motor 13 is driven upward, for instance, for 10 msec, and is then deactivated for a prescribed time period, for instance for 50 msec (step 100). As a result, the elevator motor 13 is driven in the upward direction in an intermittent mode, and the paper feed table 1 is moved upward by a distance corresponding to the intermittent drive time period.

Upon completion of one cycle of the intermittent drive mode, the print flag is checked (step 110). If the print flag is not set, the program flow is terminated. If the print flag is set, it is then determined if the upper limit sensor 19 is in the 0N state or not (step 120).

If the upper limit sensor 19 is not in the 0N state, the count value C is incremented by one (step 130). It is then determined if the count value C is equal to or greater than a set value, for instance 3 (step 140). If it does not hold that the count value $\geqq 3$, the program flow returns to step 90, and the elevator motor 13 is activated in the upward direction over an intermittent drive time period determined by the motor ON timer value T.

On the other hand, if the count value $\geqq 3$, the count value C is reset (step 150), and after the motor ON timer value T is incremented by a prescribed value, for instance by 10 (step 160), the elevator motor 13 is activated, in step 90, in the upward direction for a prescribed intermittent drive time period determined by the motor ON timer value T. Thus, the intermittent drive time period determined by the motor ON timer value T is extended, for instance, by 10 msec as compared to the previous cycle.

When the paper feed table 1 is lifted in step 120 to the height high enough to turn on the upper limit sensor 19 or to the height at which the upper surface of the paper stack on the paper feed table 1 comes into contact with the paper feed roller 17, it is then determined if the initial drive flag is set or not (step 170). If the initial drive flag is set or if the initial drive process is still in progress, the initial drive flag is reset (step 180) and the program flow returns to step 40 where the paper feed table 1 is temporarily lowered by a distance required for turning off the upper limit sensor 19.

On the other hand, if the initial drive flag is not set, it is then monitored if the upper limit sensor 19 is changed into the OFF state and if the print flag is set (steps 190 and 200). If the upper limit sensor 19 takes the ON state, the program flow returns to step 70 to reset the count value C to zero, and the motor 0N timer value T is again set to 10 (step 80).

As a result, the elevator motor 13 is activated into the upward movement initially at the duty cycle of 10 msec ON and 50 msec OFF. If this upward movement is continued for three identical duty cycles, and the state of the upper limit sensor 19 remains OFF, the upward drive is continued at the duty cycle of 20 msec ON and 50 msec OFF. If this upward movement is continued for three identical duty cycles, and the state of the upper limit sensor 19 still remains OFF, the ON period or the intermittent drive time period is extended to 30 msec, 40 msec, 50 msec, 60 msec . . . to infinity. Thus, the effective speed of the upward movement of the paper feed table gradually increases as more time elapses until the upper limit sensor 19 has detected that the upper surface of the paper stack on the paper feed table 1 has reached the prescribed height.

Figure 4:
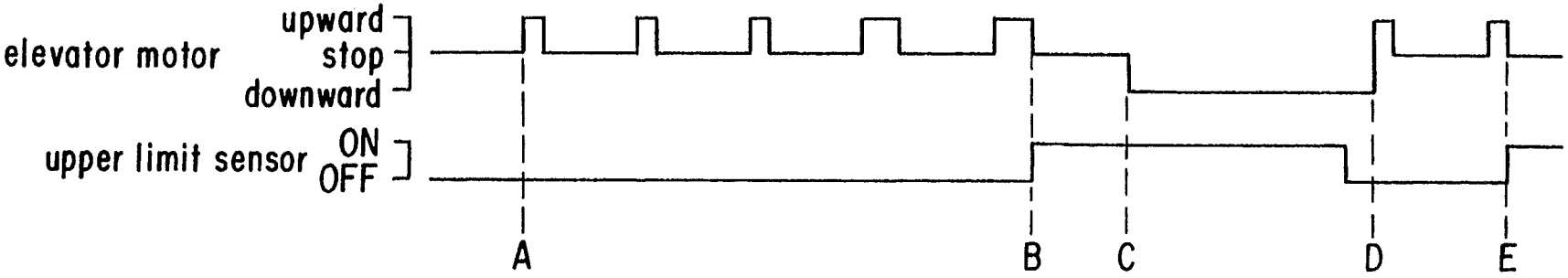
FIG. 4 is a time chart showing the initial drive process of the paper feed table by the vertical movement control-device for a paper feed table device according to the present invention.

FIG. 4 is a time chart showing the initial drive process of the paper feed table. At time point A, the upward movement of the paper feed table 1 is started at the duty cycle of 10 msec ON and 50 msec OFF by the first execution of step 90. At time point B, the upper limit sensor 19 takes the ON state, thereby stopping the upward movement of the paper feed table 1. At time point C, the temporary downward movement of the paper feed table 1 is started by the activation of the elevator motor 13. At time point D, the temporary downward movement of the paper feed table 1 by the activation of the elevator motor 13 is completed, and the upward movement of the paper feed table 1 is resumed at the duty cycle of 10 msec ON and 50 msec OFF again by the first execution of step 90. At time point E, the state of the upper limit sensor 19 takes the 0N state, and the initial setting of the paper feed table 1 is completed.

Thereafter, the paper feed rollers 17 are rotatively actuated for feeding the printing paper and forming images thereon, and the control of the vertical upward movement of the paper feed table 1 described above is continued until any one of the following events has occurred, and the print flag is reset in step 110 or step 200: (1) the print stop button for stopping the printing operation is pressed; (2) an initially prescribed number of copies have been printed; (3) the image forming process is interrupted due to a failure to properly convey the printing paper (jamming), and (4) the image forming process is interrupted because the printing paper on the paper feed table 1 has been exhausted.

As can be understood from the above description, according to the vertical movement control device for a paper feed table device of the present invention, the electric motor (elevator motor) is activated in the intermittent drive mode until the upper limit detecting means has detected that the upper surface of the paper on the paper feed table has reached a prescribed position, and the intermittent drive period is gradually increased and the effective speed of the upward movement of the paper feed table is gradually increased with the elapsing of time until the upper limit detecting means has detected that the upper surface of the paper on the paper feed table has reached the prescribed position. Thus, the voltage of the electric motor is not required to be controlled in controlling the effective speed of the upward movement of the paper feed table so that a favorable paper feeding at an appropriate paper feed pressure can be ensured without requiring any change in the setting for different kinds of paper and without involving such problems as failure to lift the paper feed table and seizure of the electric motor. Furthermore, when the lift of the paper feed table is large, for instance due to the adding of new paper and removing paper jamming, the effective speed of the upward movement of the paper feed table is increased accordingly. Thus, no substantial waiting time period is required before the paper feed table attains its prescribed height.

Although the present invention has been described above in terms of a specific embodiment, the present invention is not limited by this embodiment but it is obvious to a person skilled in the art that various embodiments are possible without departing from the spirit of the present invention.

What we claim is:

1. A vertical movement control device for a paper feed table device including a paper feed table which carries a paper stock thereon and can be vertically moved by an electric motor, comprising:

upper limit detecting means for detecting if an upper surface of said paper stack on said paper feed table has been positioned at a prescribed height by a vertical movement of said paper feed table; and control means for intermittently activating said electric motor so as to lift said paper feed table until said upper limit detecting means has detected that said upper surface of said paper stack on said paper feed table has been positioned at said prescribed height, and for gradually increasing the duty ratio of said intermittent activation of said electric motor with elapsing of time until said upper limit detecting means has detected that said upper surface of said paper stack on said paper feed table has been positioned at said prescribed height.

2. A vertical movement control device for a paper feed table device according to claim 1, wherein said duty ratio is gradually increased by increasing a period of activating said electric motor while keeping a period of deactivating said electric motor fixed in each duty cycle of said electric motor.

* * * * *